US005467792A

United States Patent [19]

Okuda

[11] Patent Number: 5,467,792

[45] Date of Patent: Nov. 21, 1995

[54] COLLAPSIBLE UMBRELLA

[76] Inventor: Toshio Okuda, 4-3, 1-Chome Sugi, Hirpakata City, Osaka, Japan

[21] Appl. No.: 321,928

[22] Filed: Oct. 12, 1994

[30] Foreign Application Priority Data

Jun. 24, 1994 [CN] China ..... 94213612.8

[51] Int. Cl.[6] ..... A45B 19/00

[52] U.S. Cl. ..... 135/25.3; 135/31; 135/37

[58] Field of Search ..... 135/25.3, 25.31, 135/26, 29, 31, 37

[56] References Cited

U.S. PATENT DOCUMENTS

| | | | |
|---|---|---|---|
| 4,658,844 | 4/1987 | Ping | 135/25.3 |
| 4,739,783 | 4/1988 | Yang | 135/25.3 |
| 4,815,489 | 3/1989 | Yang | 135/25.3 |
| 5,063,953 | 11/1991 | Wu | 135/25.3 |
| 5,193,565 | 3/1993 | Huang | 135/25.3 X |
| 5,337,770 | 8/1994 | Wang | 135/25.3 |

*Primary Examiner*—Lanna Mai
*Attorney, Agent, or Firm*—Bacon & Thomas

[57] ABSTRACT

A shortenable umbrella, essentially comprises a strut 2, a stay 3, a link 4, a rod 5, a tension wire 6, a tension link 7, a spoke 8, a rib 9, a first joint member J1 and a second joint member j2 connected each other as shown in FIG. 4 to form one rib assembly of the totally six or eight rib assemblies of a four sectioned shortenable umbrella, characterized by forming two spaced stops (A) and (B) integrally with the rod 5 at the lower edges thereof, disposing a guide ring (R) around the section of the rod 5 defined by the stops and passing the tension wire 6 beneath the groove of the rod 5 through the guide ring (R) to thereby permit the guide ring (R) moving freely along the rod under the action of the tension wire during the closing and opening operations of the umbrella.

4 Claims, 6 Drawing Sheets

COLLAPSIBLE UMBRELLA

BACKGROUND OF THE INVENTION

This invention relates to an umbrella and more particularly to an improved shortenable or collapsible umbrella of the type that may be folded into four-sections when it is not in use or when it is put in storage.

Various designs of the aforesaid type of umbrella have been developed and used nowadays since they are handy as well as convenient in storage.

For enhancing the stability in its open state and reducing the size in its closed state, I have presented an umbrella with an improved rib structure in Chinese utility model application No.94203684.0, which was filed on Feb. 18, 1994, and depicted herein in FIG. 6 of the drawings.

The above umbrella can attain the effects of enhancing its stability and reduction of size. However, the rib structure of the umbrella comprises six or eight rib assemblies pivotally arranged around the crown (10) and the slider (11), and the guide ring (R) for controlling the tension wire (6) to move along beneath the rod (5) having a cross section of a reverse U shape is fixedly mounted around the intermediate portion of the rod (5). The force applied to push the slider (11) upward along the shaft (13) to change the umbrella from closed condition to open condition, or vice versa, will act to force the tension wire (6) moving remote from or toward the shaft (13) side. Since the guide ring (R) is fixedly secured to the rod (5), the friction developed between the tension wire (6) and the guide ring (R) will hinder the smooth movement of the tension wire (6). As described above, the umbrella comprises eight rib assemblies, as such the total friction developed during the opening and closing of the umbrella will be considerable, which results in difficulties in the operation of the umbrella.

The guide ring has also been used in an umbrella such as the one disclosed in Japanese laid open utility model application No.59-120912 (dated Feb. 2, 1983), where the guide ring is fixed to the inner wall of the U-shaped groove of the rod by means of caulking. This arrangement has the same problems as those in my previous design.

To my knowledge, all the guide rings being used in umbrellas for guiding the tension wire are fixedly secured either on the rods associated therewith or on the tension wire itself.

Therefore, it is the first object of the present invention to provide an umbrella with an improved rib structure that can successfully resolve the problems associated with the prior umbrella.

The second object of the present invention is to provide an umbrella which has a reduced size in the closed condition.

In accordance with the present invention, there is provided a guide ring which may move freely on the rod during the opening and closing operations of the umbrella by virtue of the movement of the tension wire. Specifically, when the friction between the guide ring and the tension wire is larger than that between the guide ring and the rod, the guide ring will follow the movement of the tension wire to move either remote from or toward the shaft side. Consequently, the force required in the operation of the opening and closing of the umbrella will be reduced, which facilitates the operation of the umbrella.

With the above objects and advantages in view, the present invention will become more clearly understood from the following detailed description of a preferred embodiment of the present invention, in connection with the accompanying drawings, of which:

DETAILED DESCRIPTION OF THE PREFERRED EMBODIMENTS

Figure 1:
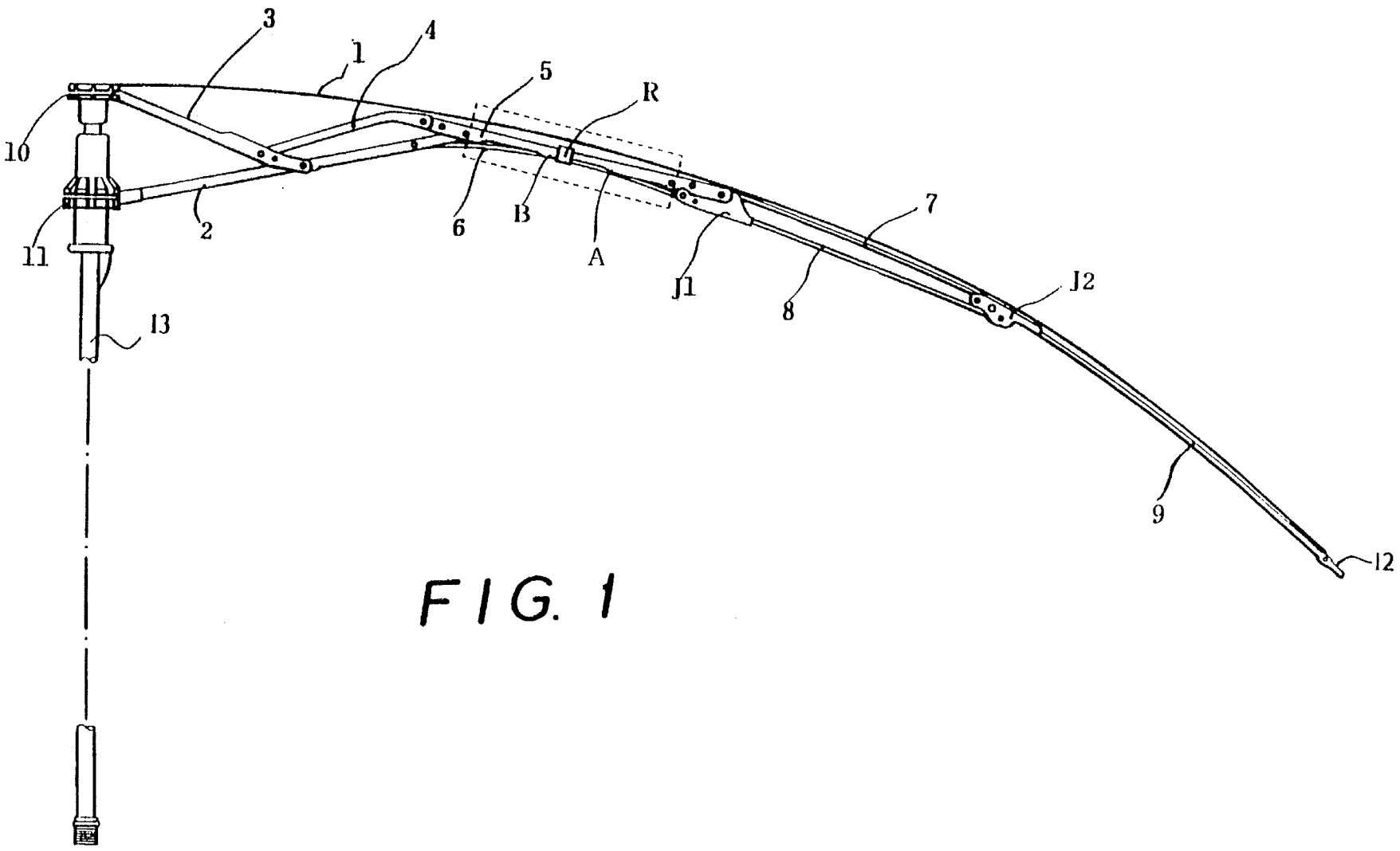
FIG. 1 is a front view of an umbrella rib structure in accordance with the present invention illustrated in open condition, whereby for better clarity of view only one rib assembly of the total eight rib assemblies is illustrated.

Referring now to the drawings wherein an embodiment example of the present invention, the rib assembly of the four sectioned shortenable umbrella is illustrated, which comprises an umbrella canopy (1), a strut (2), a stay (3), a link (4), a rod (5), a tension wire (6), a tension link (7), a spoke (8), a rib (9), a crown (10), a slider (11), a tip (12), a shortenable shaft (13), a first joint member (J1), a second joint member (J2) and a guide ring (R).

The above members constituting the present rib assembly are all the same in its structure and function as those illustrated in my above mentioned previous application except the rod (5), the spoke (8) and the guide ring (R), as such the following illustration will be directed only to the improved portion and the differences of the present invention from the previous application. Specifically, according to the present invention, there are provided a rod (5) and a spoke (8) both having a different configuration and a guide ring (R) of a type that can be moved freely along the rod (5), contrary to the one fixedly secured to the rod in my previous application.

Figure 2:
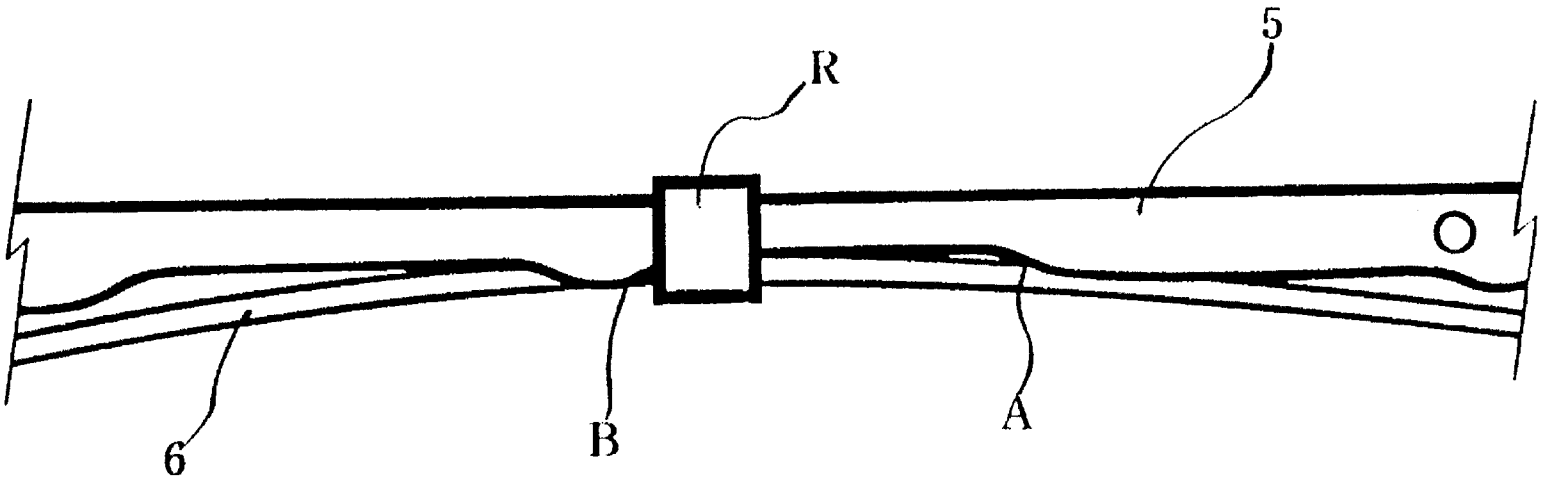
FIG. 2 is an enlarged view of the portion of the rib assembly encased with the dotted lines of FIG. 1.

As shown in FIG. 2, two spaced protrusions (A), (B) are formed integrally with the rod (5) at the lower edge thereof, acting as stops for limiting the movement of the guide ring (R) therebetween.

The protrusions may be in the form of a step formed by cutting away the lower edges of the rod (5) to define a reverse U-shaped cross section.

The protrusions or stops (A), (B) are disposed at the intermediate portion of the rod (5), where the spaced distance of the stop (A) and stop (B) is approximately one fourth of the length of the rod (5).

The guide ring (R) is slidably fitted around a portion of the rod (5) defined by the stops (A) and (B) and the tension wire (6) is passed under the groove of the rod (5) through the guide ring (R), as shown in FIG. 2.

Figure 3:
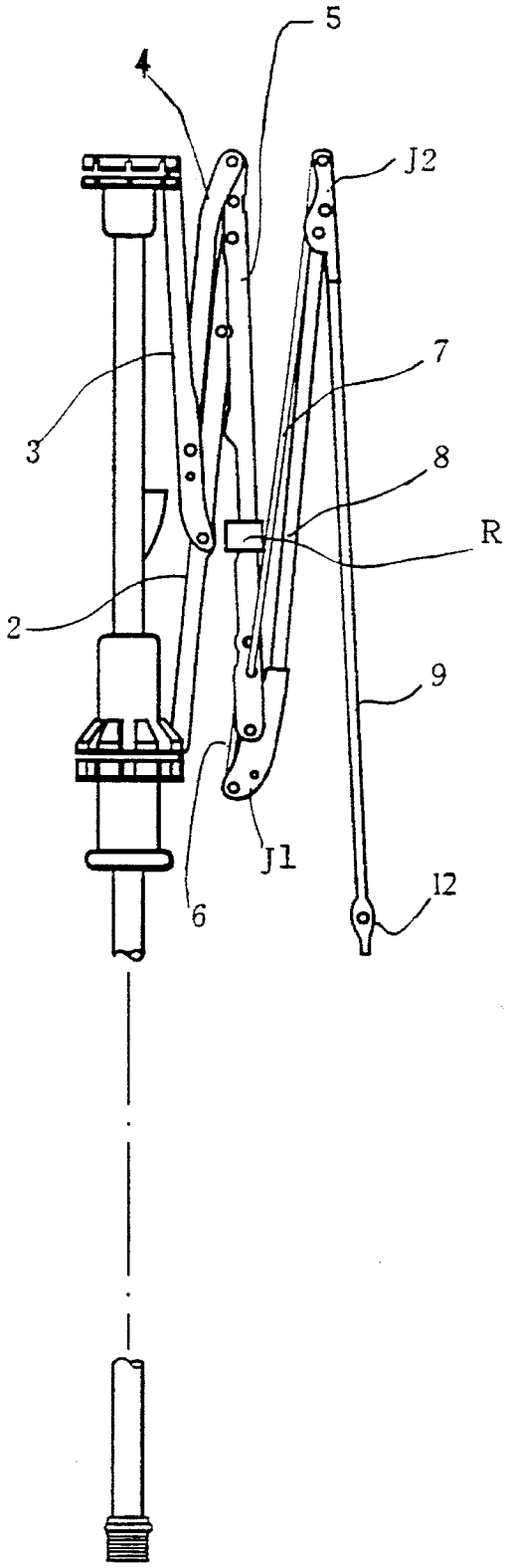
FIG. 3 is a view similar to FIG. 1 showing the rib assembly during the opening movement.

Since the guide ring (R) is permitted to move freely along the portion of the rod (5) between the stops (A) and (B), the guide ring (R) will slide down and abut on the stop (A) when the rib assembly is in a closed or nearly closed condition as shown in FIG. 3, where the rod (5) takes an upright or nearly upright position, and then the tension wire (6) is received in the groove of the rod (5) to release its engagement with the guide ring (R).

Figure 4:
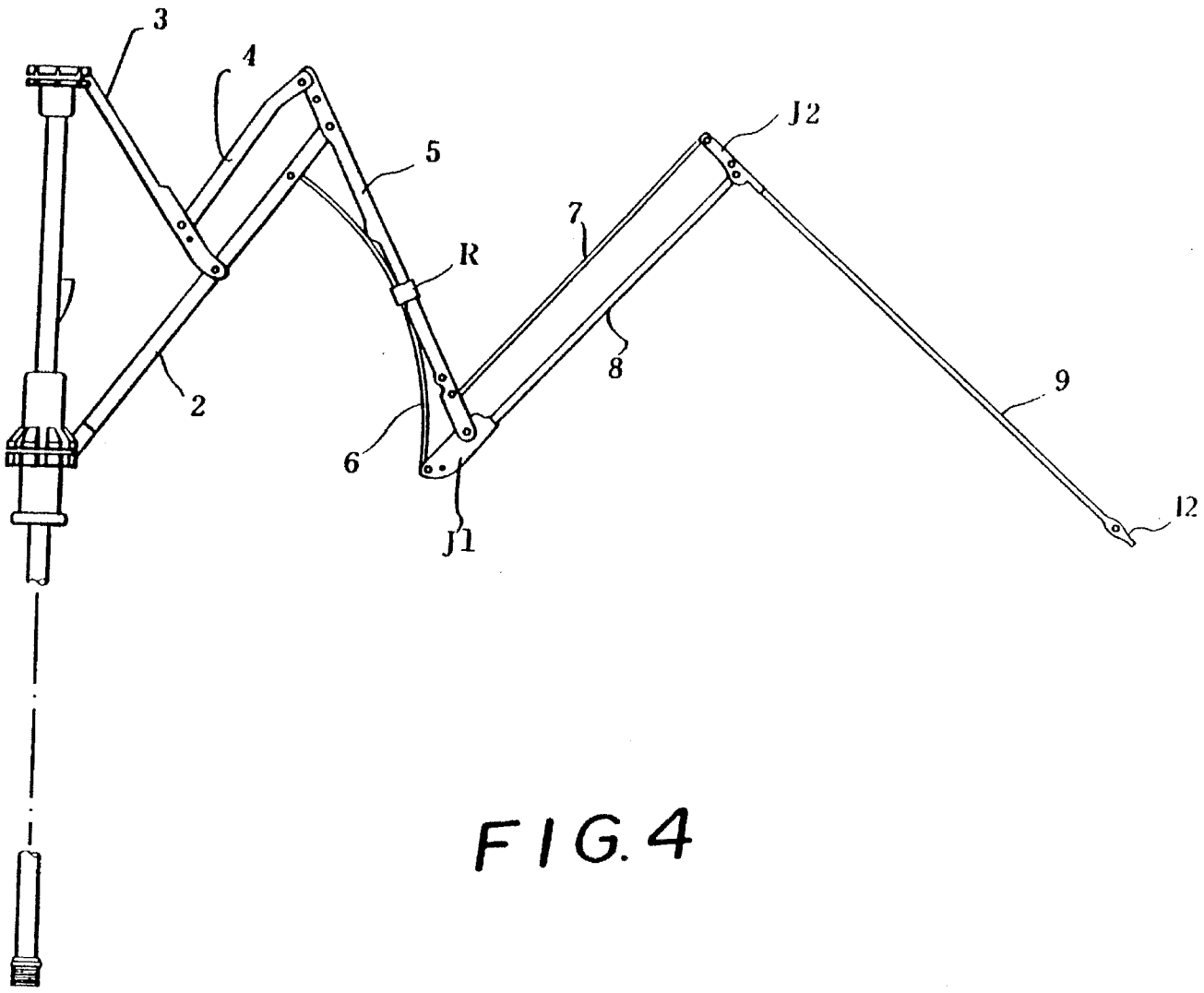
FIG. 4 is a view similar to FIG. 1 showing the rib assembly in the partially closed position.

When the rib assembly is opened from the closed condition of FIG. 3 to an open condition, a push force is first applied to the slider (11) upwardly along the shaft (13). The movement of the slider (11) then forces the strut (2), together with all the members of the other rib assembly stretching outwards and allow the rib assembly to assume the condition as shown in FIG. 4.

During the process stretching of each member of the rib assembly, the tension wire (6) previously received in the groove of the rod (5) will be curved and emerged from the groove by the interaction rendered by the outward movement of the strut (2) and the inward movement of the first joint member (J1), to the end of which one end of the tension wire (6) is pivoted. As a result, the tension wire (6) engages with the guide ring (R).

When the rib assembly continuously stretches to the point where the friction developed between the tension wire (6) and the guide ring (R) exceeds that developed between the guide ring (R) and the rod (5), the guide ring (R) will slidably move upwardly along the rod (5) due to the stretching of the tension wire (6) imported by the outward movement of the first joint member (J1). At the moment when the rib assembly is fully stretched, as in the condition shown in FIG. 1, the tension wire (6) tends to resume its originally straight form and is received in the groove of the rod (5). In this position, the guide ring (R) has disengaged from the tension wire (6) and abuts on the outer side of the stop (B).

As stated above, since the guide ring (R) is made slidable, it will not in any way hinder the stretching of the rib assembly during the opening operation of the umbrella and, consequently, the force required to be applied to the slider (11) may be minimized.

Further, when the umbrella is converted from the open condition as shown in FIG. 1 to the partially closed condition as shown in FIG. 3, a reverse operation as above described is effected. Specifically, for closing the previously described umbrella, it is only necessary to simply move the slider (11) from its uppermost position locked on the outer tube of the shaft (13) in the direction of the handle(not shown). During such operation, the slider (11) forces the first joint member (J1) to move toward the inner side or the shaft (13) side, which movement cooperates with the strut (2) to act on the tension wire (6) from both ends thereof to thereby force the tension wire (6) to curve and emerge out from the groove of the rod (5) where the tension wire (6) has been positioned. The curved tension wire (6) now starts engaging with the guide ring (R) and moves the latter along the rod (5) from the previous position near stop (B) toward the stop (A), following the movement of the tension wire (6), by means of the friction developed between the tension wire and the guide ring, to assume the condition as shown in FIG. 4.

When the rib assembly of the umbrella assumes the condition illustrated in FIG. 3, the guide ring (R) disengages from the tension wire (6) and as a result, the guide ring (R) slides freely down along the rod (5) to rest on the inner side of the stop (A).

The closing operation of the umbrella thus will be much easier than that in my previous design, since the guide ring (R) will not hinder the stretching operation of the rib assembly in accordance with the present invention.

From the foregoing, it is appreciated that the closing and opening of the umbrella in accordance with the present invention will certainly be much easier than any and all prior umbrellas of the same type.

Figure 5:
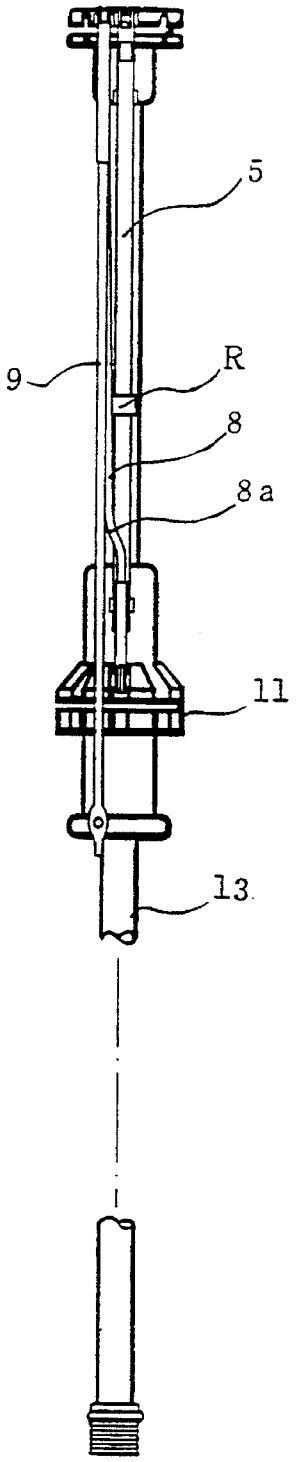
FIG. 5 is a right side view of the rib assembly of FIG. 4 in the completely closed position.
Figure 6:
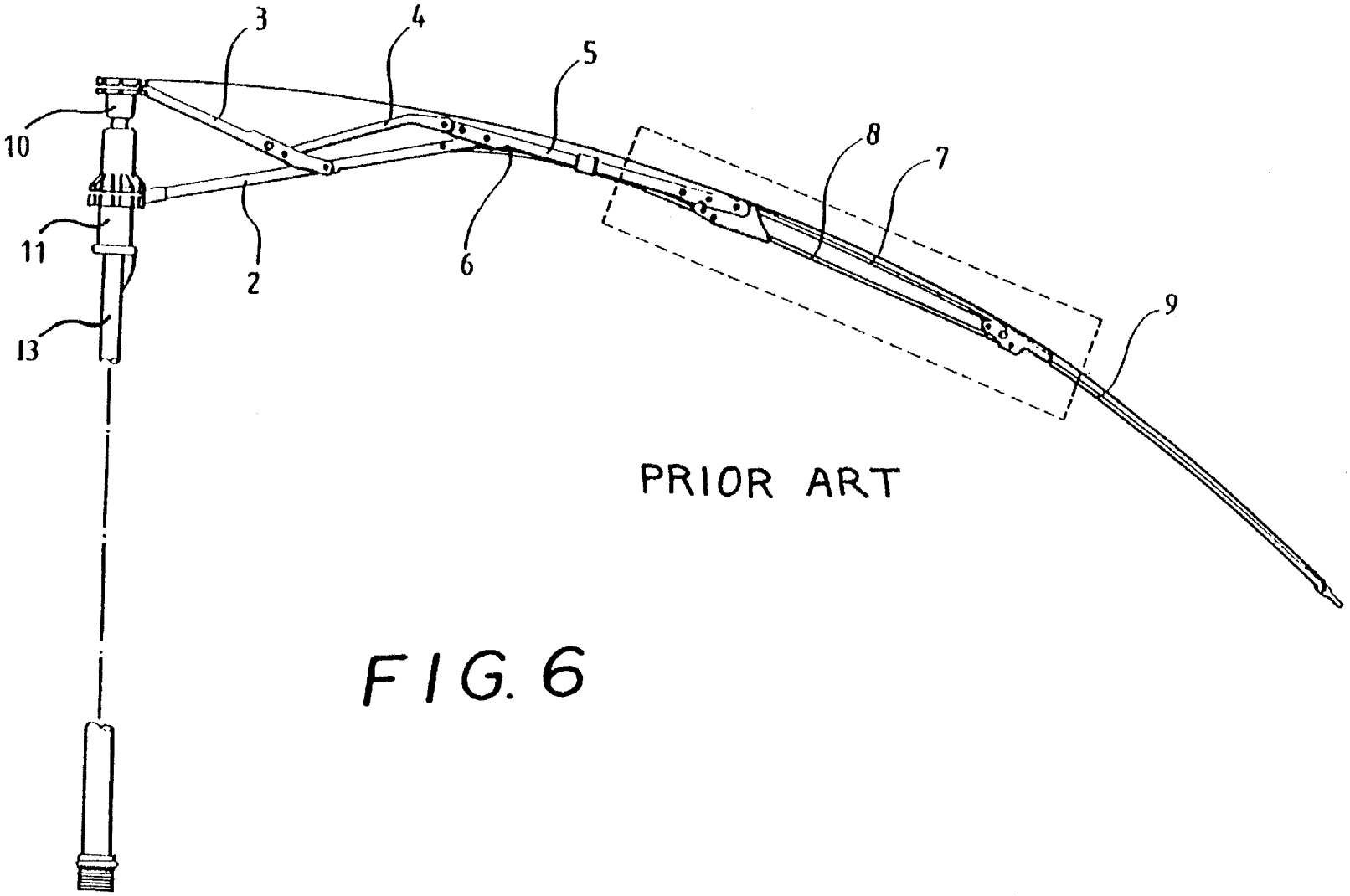
PRIOR ART FIG. 6
FIG. 6 is a view similar to FIG. 1 showing the rib assembly of the prior design disclosed in my Chinese utility model appln. No.94203684.0.

The second object of the present invention will be described, referring to FIG. 5, where the rib assembly of the present umbrella is illustrated in its closed condition.

As can be seen from the drawing, at the vicinity of the inner end of the spoke (8) there is a curved portion (8*a*) which is formed by slightly bending the spoke from the axial line thereof to the left side. In such design, the rib (9) will automatically position closely to the left side of the rod (5), so as not to superimpose outside of the rod (5), when a counter clockwise rolling action normally applied to the closed umbrella for reducing its radial size is applied.

The bending of the spoke (8) as set forth above will eventually reduce the size of the umbrella, which facilitates the storage as well as the portability of the umbrella of the type provided in accordance with the present invention.

While there has been described a preferred form of the invention, obviously modifications and variations are possible in light of the above teachings. It is therefore to be understood that within the scope of the appended claims, the invention may be practiced otherwise than as specifically described.

What is claimed is:

1. A collapsible umbrella of the type defined by a plurality of rib assemblies, with each fib assembly including a strut, a stay having one end pivotally connected to the strut between the opposite ends of the strut, a rod having a reverse U-shaped cross-section partially formed by a pair of lower edges and having a first end pivotally connected to an end of the strut, a link having a first end pivotally connected to the stay and a second end pivotally connected to the first end of the rod, a first joint member pivotally connected at a second end of the rod, a tension wire connecting the strut and the first joint member, a second joint member, a spoke connecting the first and the second joint members, a tension link connecting the second end of the rod and the second joint member, and a rib extending outwardly of the second joint member, the improvement comprising:

a pair of spaced stops integrally formed along the lower edges of the rod, a guide ring slidably mounted around the rod between the stops, the tension wire extending between the lower edges of the rod and through the guide ring, whereby the guide ring is caused to freely slide along the rod under the action of the tension wire during the opening and dosing of the umbrella.

2. The collapsible umbrella of claim 1 wherein the stops are formed in an intermediate portion of the rod.

3. The collapsible umbrella of claim 1 wherein the stops are formed by cutting away portions of the lower edges of the rod.

4. The collapsible umbrella of claim 1 wherein the spoke is bent from its longitudinal axis adjacent the inner end thereof to form a curved portion for reducing the size of the umbrella in its collapsed condition.

* * * * *